US011769953B2

(12) United States Patent
Kitano

(10) Patent No.: US 11,769,953 B2
(45) Date of Patent: Sep. 26, 2023

(54) ANTENNA DEVICE AND METHOD FOR DESIGNING SAME

(71) Applicant: NEC Corporation, Tokyo (JP)

(72) Inventor: Shinichiro Kitano, Tokyo (JP)

(73) Assignee: NEC CORPORATION, Tokyo (JP)

( * ) Notice: Subject to any disclaimer, the term of this patent is extended or adjusted under 35 U.S.C. 154(b) by 3 days.

(21) Appl. No.: 17/618,259

(22) PCT Filed: Jun. 19, 2020

(86) PCT No.: PCT/JP2020/024086
§ 371 (c)(1),
(2) Date: Dec. 10, 2021

(87) PCT Pub. No.: WO2020/256093
PCT Pub. Date: Dec. 24, 2020

(65) Prior Publication Data

US 2022/0352642 A1 Nov. 3, 2022

(30) Foreign Application Priority Data

Jun. 20, 2019 (JP) ..... 2019-114922

(51) Int. Cl.

| | |
|---|---|
| ***H01Q 15/16*** | (2006.01) |
| ***H01Q 19/17*** | (2006.01) |
| ***H01Q 21/08*** | (2006.01) |
| ***H01Q 25/00*** | (2006.01) |

(52) U.S. Cl.
CPC ..... *H01Q 15/16* (2013.01); *H01Q 19/17* (2013.01); *H01Q 21/08* (2013.01); *H01Q 25/007* (2013.01)

(58) Field of Classification Search
CPC ..... H01Q 15/06; H01Q 19/17; H01Q 21/08; H01Q 25/007
See application file for complete search history.

(56) References Cited

U.S. PATENT DOCUMENTS 3,255,455 A * 6/1966 Von Trentini ..... H01Q 19/191 343/781 R
3,795,004 A * 2/1974 Meek ..... H01Q 19/18 343/837
5,298,909 A * 3/1994 Peters ..... H01Q 21/28 342/53
5,440,801 A * 8/1995 Marks ..... H01Q 1/38 29/601
5,581,267 A * 12/1996 Matsui ..... H01Q 19/10 343/837

(Continued)

FOREIGN PATENT DOCUMENTS

JP S50-062345 A 5/1975
JP S53-15045 A 2/1978

(Continued)

OTHER PUBLICATIONS

International Search Report for PCT Application No. PCT/JP2020/024086, dated Sep. 24, 2020.

(Continued)

*Primary Examiner* — Lam T Mai

(57) ABSTRACT

An antenna device provided with a single reflecting mirror having multiple focal points, and multiple primary radiators provided at respective positions of the multiple focal points.

4 Claims, 6 Drawing Sheets

(56) References Cited

U.S. PATENT DOCUMENTS 6,061,033 A * 5/2000 Hulderman ..... H01Q 3/20 343/781 CA
6,172,650 B1 * 1/2001 Ogawa ..... H01Q 19/19 343/836
6,667,720 B1 * 12/2003 Anderton ..... H01Q 19/191 343/757
7,271,899 B2 * 9/2007 Anderton ..... G01V 8/005 343/754
7,878,191 B2 * 2/2011 Bender ..... H02S 20/10 126/696
8,322,332 B2 * 12/2012 Rogers ..... F24S 30/458 126/606
8,638,267 B2 * 1/2014 Omuro ..... H01Q 19/134 343/781 R
8,686,910 B1 * 4/2014 Ives ..... H01P 1/24 333/22 R
2002/0118140 A1 * 8/2002 Ogawa ..... H01Q 19/195 343/834
2009/0267850 A1 * 10/2009 Parsche ..... H01Q 15/0006 343/834
2012/0320344 A1 * 12/2012 Okumura ..... G02B 6/0031 362/231
2015/0061956 A1 * 3/2015 Yano ..... H01Q 15/16 343/781 CA
2018/0159243 A1 * 6/2018 Britz ..... H01Q 3/247
2018/0287263 A1 * 10/2018 Hirabe ..... H01Q 19/19
2019/0296445 A1 * 9/2019 Takikawa ..... H01Q 15/0033
2019/0386395 A1 * 12/2019 Kashino ..... H01Q 19/19
2020/0021786 A1 * 1/2020 Watanabe ..... H04N 9/3194
2020/0301041 A1 * 9/2020 Partee ..... G01V 8/005

FOREIGN PATENT DOCUMENTS

JP S56-110305 A 9/1981
JP S63-146502 A 6/1988
JP H04-100302 A 4/1992
JP H11-225017 A 8/1999

OTHER PUBLICATIONS

Extended European Search Report for EP Application No. EP20827279.9 dated Jul. 13, 2022.

* cited by examiner

| | FORWARD DIRECTION | PEAK ANGLE (POSITIVE SIDE) |
|---|---|---|
| ANGLE DIVERSITY INDICATED IN FIG. 3 | — | 0.487° |
| ANGLE DIVERSITY ACCORDING TO FIRST EMBODIMENT | 0.85dB IMPROVEMENT | 0.460° (0.02° IMPROVEMENT) |

ANTENNA DEVICE AND METHOD FOR DESIGNING SAME

This application is a National Stage Entry of PCT/JP2020/024086 filed on Jun. 19, 2020, which claims priority from Japanese Patent Application 2019-114922 filed on Jun. 20, 2019, the contents of all of which are incorporated herein by reference, in their entirety.

TECHNICAL FIELD

The present invention relates to an antenna device and a method for designing the same.

BACKGROUND ART

Patent Document 1 below discloses an antenna device in which a plurality of primary radiators are arranged near a single focal point of a parabolic reflecting mirror.

CITATION LIST

Patent Literature

[Patent Document 1]

Japanese Unexamined Patent Application, First Publication No. H11-225017

SUMMARY OF THE INVENTION

Problems to be Solved by the Invention

The above-mentioned antenna device has a structure in which primary radiators are installed side-by-side in the vicinity of a single focal point. For this reason, the radiation directions of radio waves radiated from the antenna device deviate from a desired direction (for example, the central axis of the parabolic reflecting mirror). As a result thereof, in communication using the above-mentioned antenna device, the gain of the antenna device in a desired direction decreases during transmission and reception of radio waves.

The present invention was developed in consideration of these circumstances, and has, as an example of an objective thereof, to mitigate decreases in the gain of the antenna device in a desired direction.

Means for Solving the Problems

An aspect of the present invention is an antenna device provided with a single reflecting mirror having multiple focal points, and multiple primary radiators provided at respective positions of the multiple focal points.

An aspect of the present invention is a method for designing an antenna device. The method includes a first step of installing, at prescribed positions that are adjacent to each other, a first primary radiator and a second primary radiator that can radiate electromagnetic waves towards a reflecting mirror; and a second step of designing a mirror surface of the reflecting mirror so as to have a first focal point and a second focal point, the first focal point being aligned with an installation position of the first primary radiator, and the second focal point being aligned with an installation position of the second primary radiator.

Advantageous Effects of Invention

As explained above, according to the present invention, decreases in the gain of an antenna device in a desired direction can be mitigated.

EXAMPLE EMBODIMENT

Hereinafter, the antenna device according to the present embodiment will be explained by using the drawings.

First Embodiment

Figure 1:
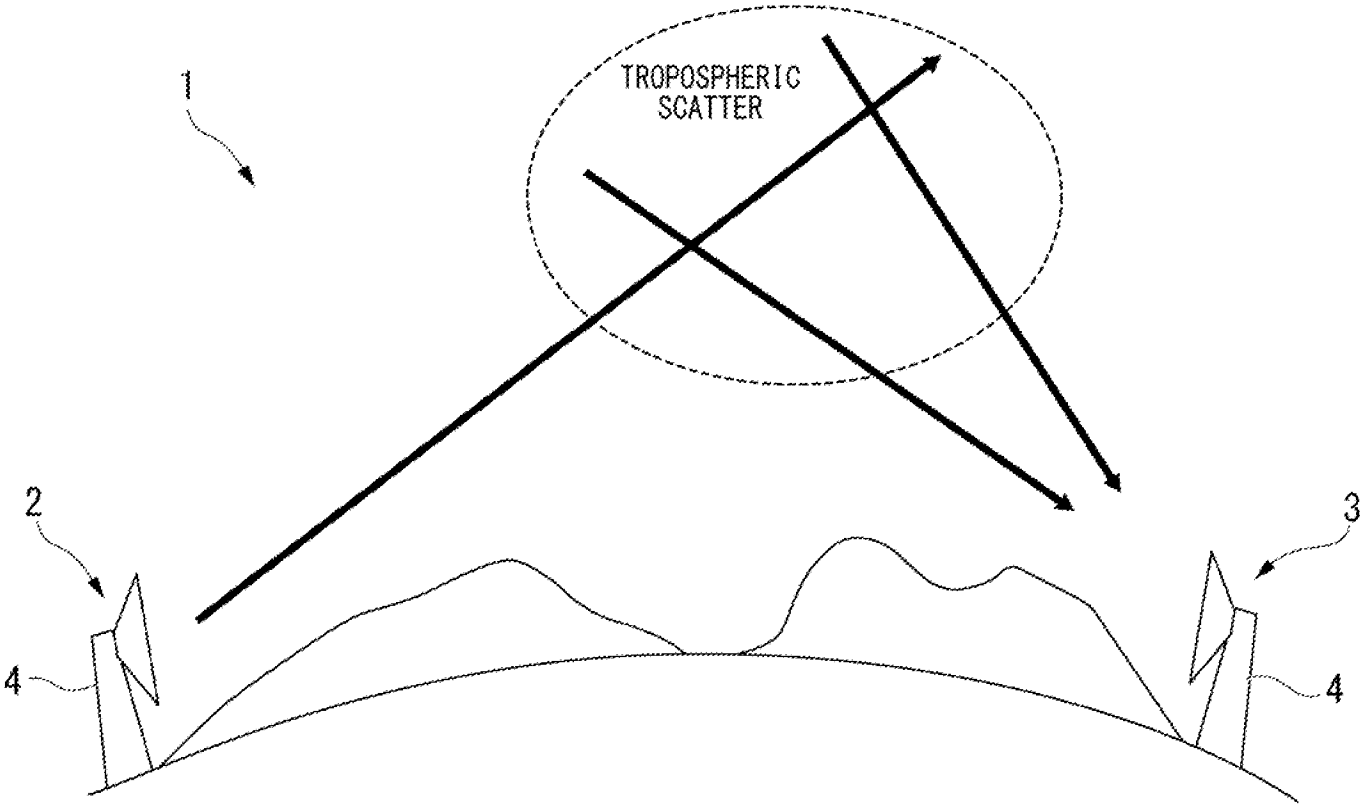
FIG. 1 is a diagram illustrating an example of the schematic structure of a communication system 1 according to a first embodiment.

FIG. 1 is a diagram illustrating an example of the schematic structure of a communication system 1 according to a first embodiment.

The communication system 1 according to the present embodiment is a system that communicates by means of over-the-horizon communication.

Over-the-horizon communication is a one-to-one communication system making use of tropospheric scatter and mountain diffraction of radio waves. It is used, for example, for communicating between distant points, such as when transmission and reception points are separated by more than 100 km, or for communicating between points having an obstacle, such as mountainous terrain, therebetween. Additionally, over-the-horizon communication is used to set up temporary communication lines in the event of a disaster or an emergency.

Over-the-horizon communication is susceptible to fading effects because there are multiple transmission paths of radio waves due to scattering and diffraction. Therefore, diversity systems are often employed in order to reduce the effects of fading in over-the-horizon communication. Diversity systems include space diversity systems in which multiple antennas are provided, frequency diversity systems making use of different frequencies, and angle diversity systems in which multiple primary radiators are constructed in a single parabola antenna. In the communication system 1 of the present embodiment, radio waves are transmitted and received by the angle diversity system.

Hereinafter, the structure of the communication system 1 according to the first embodiment will be explained by using FIG. 1.

As illustrated in FIG. 1, the communication system 1 is provided with a transmission device 2 and a reception device 3.

The transmission device 2 and the reception device 3 are each provided with an antenna device 4 and perform over-the-horizon communication by the angle diversity system.

The respective antenna devices 4 in the transmission device 2 and the reception device 3 have similar structures. However, in order to distinguish therebetween, the antenna device 4 in the transmission device 2 will sometimes be referred to as a transmission antenna, and the antenna device 4 in the reception device 3 will sometimes be referred to as a reception antenna.

The transmission device 2 radiates radio waves from the transmission antenna. The radio waves radiated from the transmission device 2 propagate in multiple different directions, for example, by being scattered by the troposphere.

The reception device 3 receives radio waves arriving from respectively different directions with the reception antenna.

Figure 2:
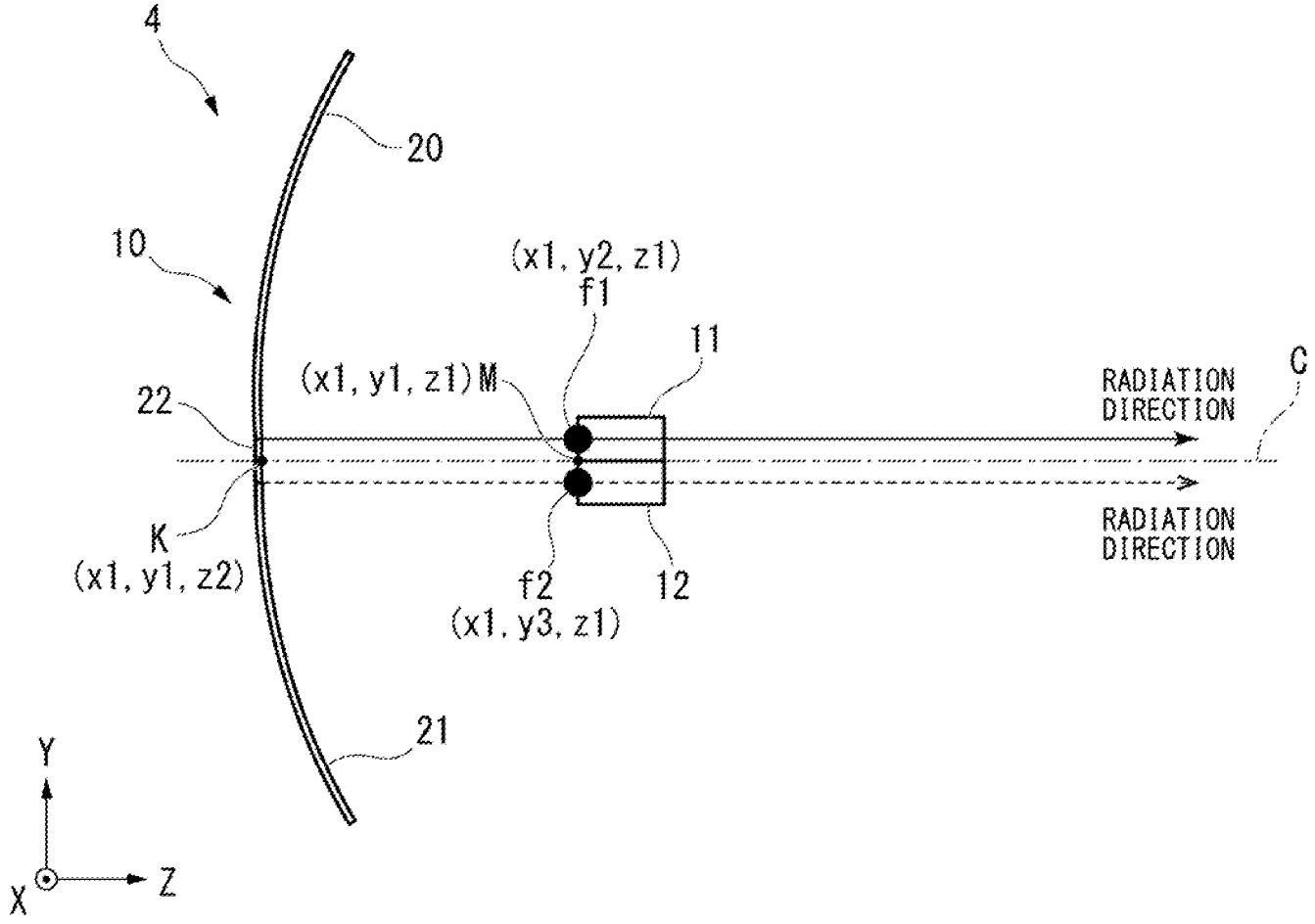
FIG. 2 is a side view of an antenna device 4 according to the first embodiment.

Next, the structure of the antenna device 4 according to the first embodiment will be explained by using FIG. 2. FIG. 2 is a structural diagram of the antenna device 4 according to the first embodiment, viewed from a side surface.

The antenna device 4 is a so-called parabola antenna.

As illustrated in FIG. 2, the antenna device 4 is provided with one reflecting mirror 10 and two primary radiators 11, 12. The primary radiator 11 is an example of the "first primary radiator" in the present invention. The primary radiator 12 is an example of the "second primary radiator" in the present invention.

The reflecting mirror 10 is a reflector having a parabolic curved surface. The reflecting mirror 10 has two focal points, namely, a first focal point f1 and a second focal point f2.

The first focal point f1 and the second focal point f2 are located on a single straight line perpendicular to the central axis C of the reflecting mirror 10.

The primary radiator 11 is provided at the position of the first focal point f1. The primary radiator 11 is, for example, a square waveguide.

The primary radiator 12 is provided at the position of the second focal point f2. The primary radiator 12 is a square waveguide.

The primary radiator 11 and the primary radiator 12 are adjacent to each other in a direction (hereinafter referred to simply as the "perpendicular direction") perpendicular to the central axis C of the reflecting mirror 10. For example, the primary radiator 11 and the primary radiator 12 may be composed of a single body. In this case, the central axis C of the reflecting mirror 10 is defined as the "Z axis" in an orthogonal coordinate system in three-dimensional space, the above-mentioned perpendicular direction is defined as the "Y axis", and the direction perpendicular to the YZ plane is defined as the "X axis".

Next, the structure of the reflecting mirror 10 according to the present embodiment will be explained.

The reflecting mirror 10 is provided with a first parabolic mirror 20, a second parabolic mirror 21 and a planar member 22.

The first parabolic mirror 20 is a reflecting mirror having the first focal point f1 as the focal point.

The second parabolic mirror 21 is a reflecting mirror having the second focal point f2 as the focal point.

The planar member 22 is a planar metal plate provided between the first parabolic mirror 20 and the second parabolic mirror 21. The planar member 22 connects the first parabolic mirror 20 with the second parabolic mirror 21.

Hereinafter, the positions and the shapes of the first parabolic mirror 20, the second parabolic mirror 21 and the planar member 22 will be explained in detail.

In the above-mentioned orthogonal coordinate system, a single parabolic mirror having a focal point at the point M (x1, y1, z1), which is an arbitrary point on the Z axis, is assumed. Additionally, the center point K of this assumed parabolic mirror (hereinafter referred to as the "hypothetical parabolic mirror") is defined as (x1, y1, z2). In this case, $z2<z1$. In other words, the point M is located in the positive Z-axis direction relative to the center point K.

For example, this hypothetical parabolic mirror is a reflecting mirror that reflects radio waves in the positive Z-axis direction. Furthermore, this hypothetical parabolic mirror is split in two by a plane parallel to the X-axis direction and passing through the center point K. Of this hypothetical parabolic mirror that has been split in two, the hypothetical parabolic mirror on the upper side is defined as a first parabolic mirror 20 and the hypothetical parabolic mirror on the lower side is defined as a second parabolic mirror 21. Furthermore, the first parabolic mirror 20 is arranged so that the position of the first focal point f1 thereof is aligned with the position of the primary radiator 11. Additionally, the second parabolic mirror 21 is arranged so that the position of the second focal point f2 thereof is aligned with the position of the primary radiator 12.

The present embodiment illustrates an example of a case in which the position of the primary radiator 11 is (x1, y2, z1) and the position of the primary radiator 12 is (x1, y3, z1). In this example, the primary radiator 11 is located in the positive Y-axis direction relative to the primary radiator 12. Of the hypothetical parabolic mirror that is split in two, the hypothetical parabolic mirror on the upper side is shifted in the positive Y-axis direction by ($|y1-y2|$), and the hypothetical parabolic mirror on the lower side is shifted in the negative Y-axis direction by ($|y1-y3|$). As a result thereof, a first parabolic mirror 20 in which the position of the first focal point f1 thereof is aligned with the position of the primary radiator 11 and a second parabolic mirror 21 in which the position of the second focal point f2 thereof is aligned with the position of the primary radiator 12 are constructed.

The planar member 22 is inserted in a gap between the first parabolic mirror 20 and the second parabolic mirror 21 that are split in two, and connects the first parabolic mirror 20 with the second parabolic mirror 21. Therefore, the width of the planar member 22 in a short-side direction corresponds to the interfocal distance between the first focal point f1 and the second focal point f2 in the Y-axis direction, which is equal to ($|y2-y3|$).

The planar member is an example of the "metal member" in the present invention.

Next, the operations of the antenna device 4 according to the first embodiment will be explained.

When the antenna device 4 is being used as a transmission antenna, the primary radiator 11 radiates radio waves in a direction parallel to the central axis C, i.e., in the negative Z-axis direction, towards the reflecting mirror 10. The radio waves radiated from the primary radiator 11 in the negative Z-axis direction are reflected by the first parabolic mirror 20 of the reflecting mirror 10 and are radiated in the positive Z-axis direction (forward direction). Meanwhile, when the antenna device 4 is being used as a transmission antenna, the primary radiator 12 does not radiate radio waves. That is, when the antenna device 4 is used as a transmission antenna, of the primary radiator 11 and the primary radiator 12, only the primary radiator 11 radiates radio waves towards the reflecting mirror 10.

When the antenna 4 is being used as a reception antenna, the primary radiator 11 receives first radio waves reflected by the reflecting mirror 10. When the antenna 4 is being used as a reception antenna, the primary radiator 12 receives second radio waves reflected by the reflecting mirror 10. That is, when the antenna device 4 is being used as a reception antenna, both the primary radiator 11 and the primary radiator 12 are used.

Figure 3:
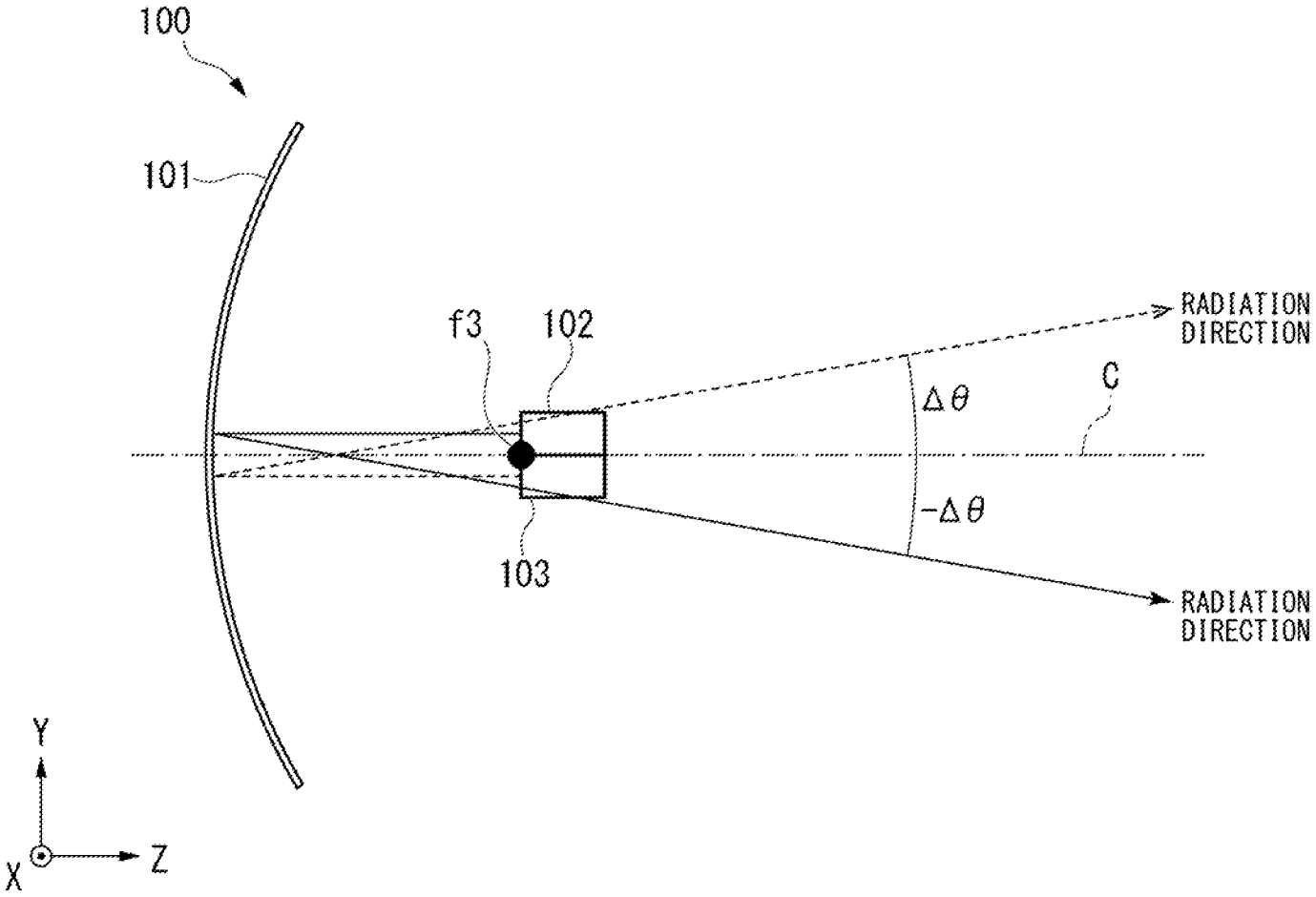
FIG. 3 is a structural diagram of an angle-diversity antenna device 100 in which two primary radiators 102, 103 are arranged near a focal point f3 of a parabolic reflecting mirror 101.

Hereinafter, the functions and effects of the antenna device 4 according to the first embodiment will be explained. FIG. 3 shows an antenna device 100 as a comparative example. FIG. 3 is a structural diagram of an angle-diversity antenna device 100 in which two primary radiators 102, 103 are arranged near a focal point f3 of a parabolic reflecting mirror 101.

Figure 4:
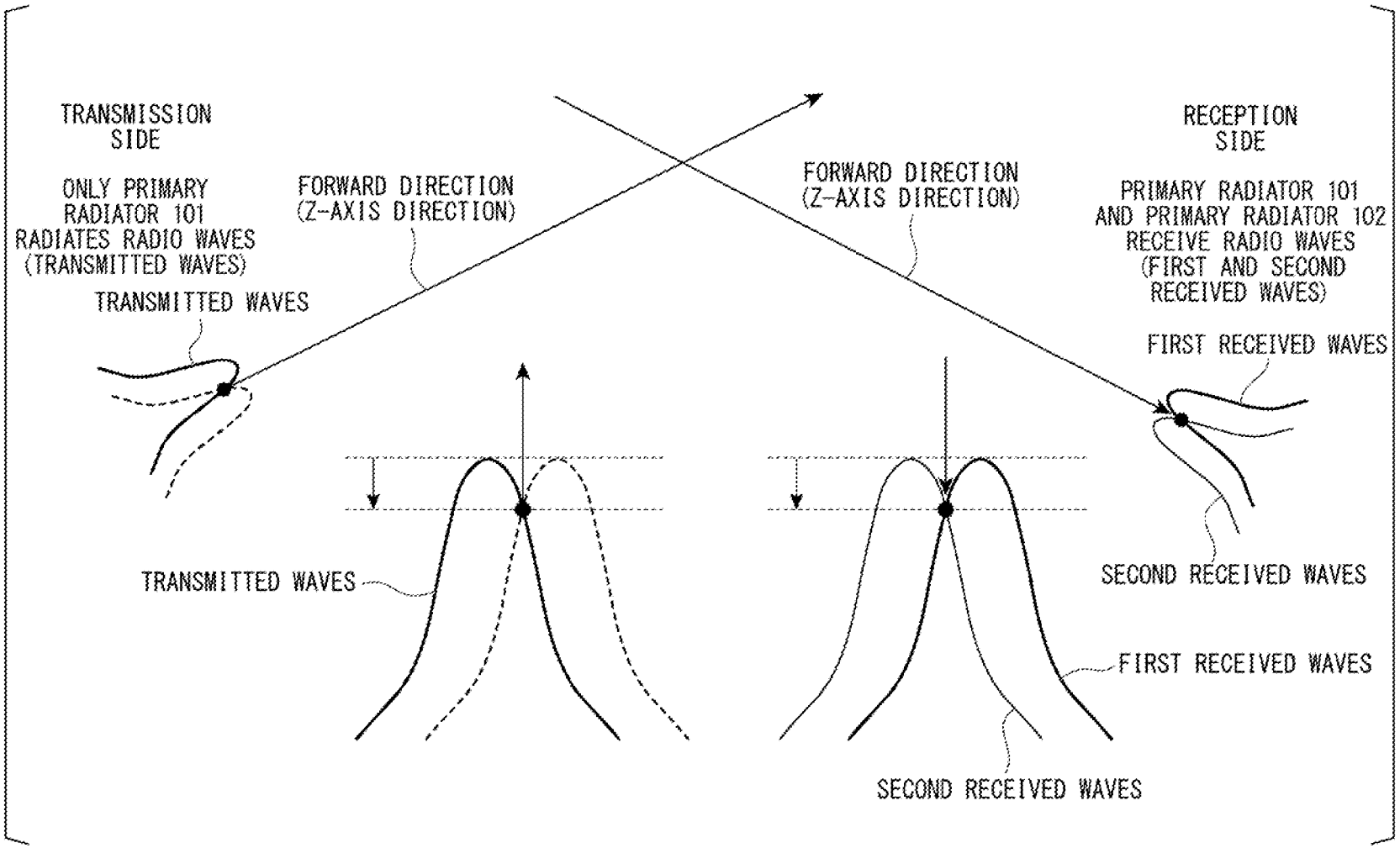
FIG. 4 is a diagram for explaining the gain in the antenna device 100 illustrated in FIG. 3.

As illustrated in FIG. 3, the antenna device 100 has two primary radiators 102, 103 that are constructed in the perpendicular direction, i.e., the Y-axis direction, and that are located at the focal point f3 of the parabolic reflecting mirror 101. In this case, the primary radiators 102, 103 are square waveguides that have volume. For this reason, it is not possible to place both of the primary radiators 102, 103 at the focal point f3, and the primary radiators 102, 103 are each arranged to be at positions slightly offset from the focal point f3. Therefore, the radiation direction of radio waves radiated from the antenna device 100 deviate from the Z-axis direction by $\Delta\theta$. As a result thereof, in the radiation pattern, the peaks of the radio waves are offset in the Z-axis direction, as illustrated in FIG. 4. That is, in angle diversity for communicating in the Z-axis direction, the gain decreases for both transmission and reception.

In contrast therewith, the antenna device 4 according to the first embodiment is provided with a reflecting mirror 10 having two focal points f1, f2, and the mirror surface of the reflecting mirror 10 is corrected so that the position of the focal point f1 thereof is aligned with the position of the primary radiator 11 and the position of the focal point f2 is aligned with the position of the primary radiator 12. As a result thereof, the above-mentioned deviation of $\Delta\theta$ can be mitigated, and decreases in the gain in the Z-axis direction can be mitigated for both transmission and reception.

Figures 5, 6:
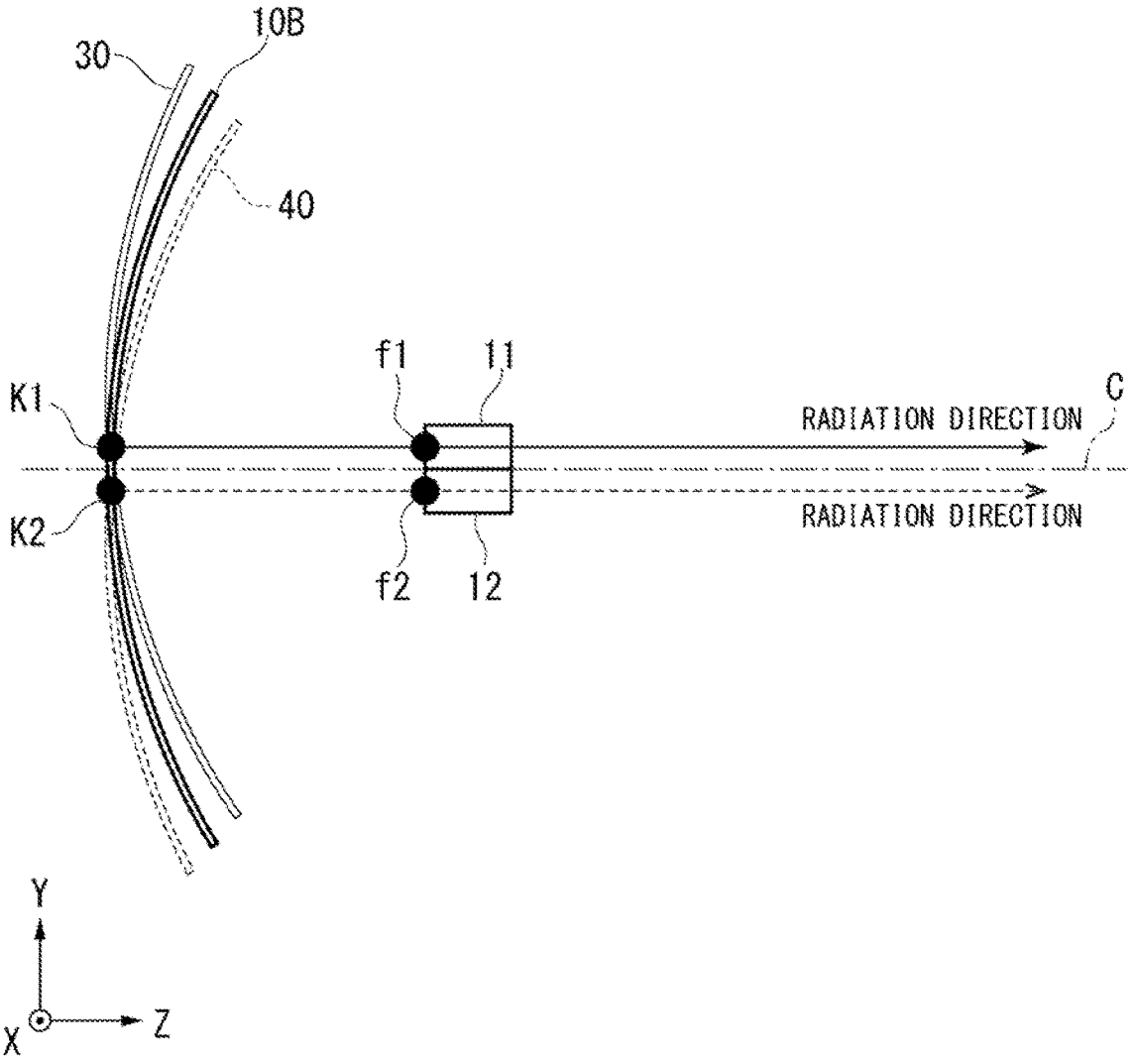
FIG. 5 is a diagram illustrating simulation results of the forward-direction gain and the peak angle in the antenna device 100 and the antenna device 4 according to the first embodiment.
FIG. 6 is a side view of an antenna device 4B according to a second embodiment.

FIG. 5 shows simulation results for the forward-direction gain and the peak angle in the antenna device 100 of the comparative example illustrated in FIG. 3 and the antenna device 4 according to the first embodiment. FIG. 5 shows simulation results for the case in which the aperture of the antenna device is 10 m and the focal length is 4.3 m.

As shown in FIG. 5, from the simulation results, it was confirmed that, in the antenna device 4 according to the first embodiment, the value of $\Delta\theta$ becomes smaller and the forward-direction gain is improved in comparison with the antenna device 100 in the comparative example.

Second Embodiment

Hereinafter, an antenna device 4B according to a second embodiment will be explained. The antenna device 4B according to the second embodiment differs from the antenna device 4 of the first embodiment in that the shape of the reflecting mirror is different, and is the same as the first embodiment in terms of all other structures. In the drawings, portions that are identical or similar are assigned identical reference numbers, and redundant descriptions may be omitted.

Hereinafter, the antenna device 4B according to the second embodiment will be explained.

Like the first embodiment, the antenna device 4B is used as both a transmission device and a reception device in over-the-horizon communication for transmitting and receiving radio signals in an angle diversity system.

The antenna device 4B is a so-called parabola antenna.

Next, the structure of the antenna device 4B according to the second embodiment will be explained by using FIG. 6. FIG. 6 is a diagram illustrating an example of the schematic structure of the antenna device 4B according to the second embodiment.

As illustrated in FIG. 6, the antenna device 4B is provided with one reflecting mirror 10B and two primary radiators 11, 12.

The reflecting mirror 10B is a reflector having a parabolic curved surface. The reflecting mirror 10B has two focal points, namely, a first focal point f1 and a second focal point f2.

The first focal point f1 and the second focal point f2 are located on a single straight line perpendicular to the central axis C of the reflecting mirror 10B.

Next, the structure of the reflecting mirror 10B according to the present embodiment will be explained.

The reflecting mirror 10B is a reflecting mirror having, as a mirror surface, a parabolic surface passing through midpoints between a first hypothetical parabolic mirror 30 and a second hypothetical mirror 40 as viewed from the X-axis direction. The first hypothetical parabolic mirror 30 is a hypothetical parabolic mirror, a focal point (first focal point f1) of which is aligned with the position of the primary radiator 11. The second hypothetical parabolic mirror 40 is a hypothetical parabolic mirror, a focal point (second focal point f2) of which is aligned with the position of the primary radiator 12.

The first hypothetical parabolic mirror 30 has a parabolic surface rotated about the first focal point f1 with the center K1 of the surface as the origin.

The second hypothetical parabolic mirror 40 has a parabolic surface rotated about the second focal point f2 with the center K2 of the surface as the origin.

The reflecting mirror 10B is a reflecting mirror obtained by correcting the mirror surface (hereinafter referred to as "mirror surface correction") so that the mirror surface is a curved surface obtained by plotting the midpoints between the parabolic surface of the first hypothetical parabolic mirror 30 and the parabolic surface of the second hypothetical parabolic mirror 40 when viewed from the X-axis direction.

Thus, the antenna device 4B according to the second embodiment is provided with a reflecting mirror 10B having two focal points f1, f2. Additionally, mirror surface correction has been performed on the reflecting mirror 10B so that the position of the focal point f1 thereof is aligned with the position of the primary radiator 11, and the position of the focal point f2 is aligned with the position of the primary radiator 12. As a result thereof, the above-mentioned deviation of $\Delta\theta$ can be mitigated, and decreases in the gain in the Z-axis direction can be mitigated for both transmission and reception.

The operations of the antenna device 4B according to the second embodiment are the same as those in the first embodiment. Thus, the explanation thereof will be omitted.

<Minimum Structure Embodiment of Antenna Device>

Figure 7:
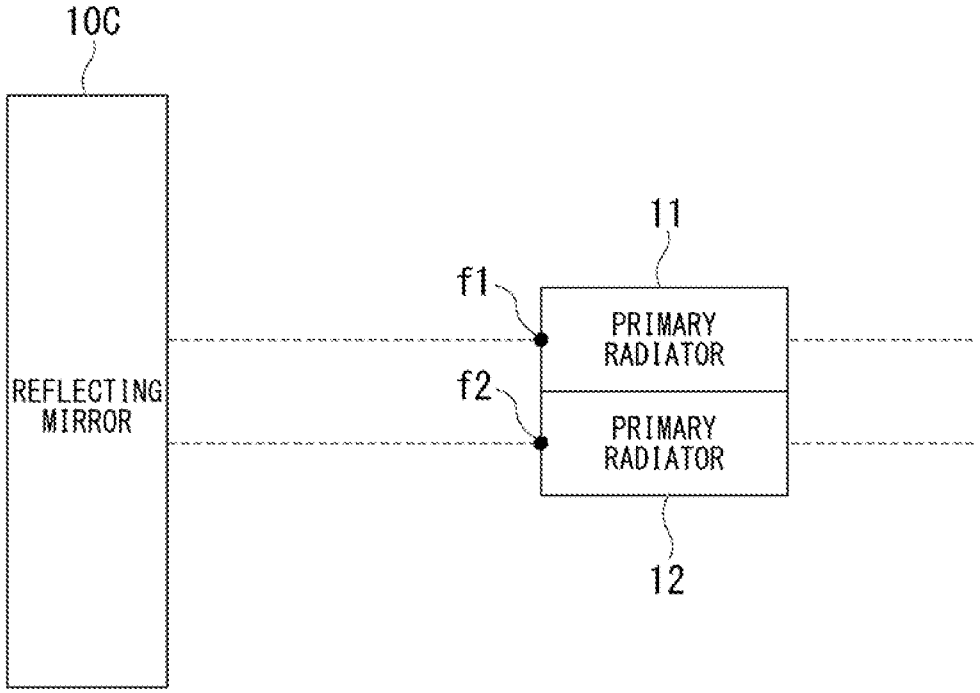
FIG. 7 is a diagram for explaining the minimum structure of the antenna device according to the present embodiment.

A minimum structure embodiment of the antenna device will be explained with reference to FIG. 7.

The antenna device according to the present embodiment is provided with a reflecting mirror 10C and two primary radiators 11, 12.

The reflecting mirror 10C has two focal points f1, f2.

The primary radiators 11, 12 are provided at the respective positions of the focal points f1, f2 of the reflecting mirror 10C.

As a result thereof, the above-mentioned deviation of $\Delta\theta$ can be mitigated, and decreases in the gain in the Z-axis direction can be mitigated for both transmission and reception.

The reflecting mirror 10C may be the reflecting mirror 10 according to the first embodiment, or may be the reflecting mirror 10B according to the second embodiment. Additionally, the reflecting mirror 10C is not limited to the reflecting mirror 10 and the reflecting mirror 10B, and may be of any shape as long as it is a parabolic reflecting mirror provided with two focal points f1, f2.

Furthermore, the focal points of the reflecting mirror 10C are not limited to being the two focal points f1 and f2, and there may be more than two focal points.

The method for designing the antenna device according to the first embodiment or the second embodiment, in one example, includes at least a first step and a second step.

The first step is a step of installing, at prescribed positions that are adjacent to each other, the primary radiator 11 and the primary radiator 12 that can radiate electromagnetic waves towards the reflecting mirror 10 (or the reflecting mirror 10B).

The second step is a step of designing a mirror surface of the reflecting mirror 10 (or the reflecting mirror 10B). That is, the second step involves designing the mirror surface of the reflecting mirror 10 (or the reflecting mirror 10B) so as to have a first focal point f1 and a second focal point f2, the first focal point f1 being aligned with the installation position of the primary radiator 11, and the second focal point f2 being aligned with the installation position of the primary radiator 12.

Although embodiments of the present invention have been explained above, these embodiments are merely illustrative, and are not intended to limit the scope of the invention. These embodiments may be implemented in various other forms, and various omissions, substitutions or changes may be made within a range not departing from the spirit of the invention. Just as these embodiments and modifications thereof are included within the scope and the spirit of the invention, they are also included within the inventions recited in the claims and the range of equivalents thereof.

The present application claims the benefit of priority based on Japanese Patent Application No. 2019-114922, filed Jun. 20, 2019, the entire disclosure of which is incorporated herein by reference.

INDUSTRIAL APPLICABILITY

According to the present invention, decreases in the gain of an antenna device in a desired direction can be mitigated.

REFERENCE SIGNS LIST

4, 4B Antenna device
10, 10B Reflecting mirror
11, 12 Primary radiator
20 First parabolic mirror
21 Second parabolic mirror
22 Planar member
f1 First focal point
f2 Second focal point

What is claimed is:

1. An antenna device comprising:

a reflecting mirror having multiple focal points which are located on a single straight line in a perpendicular direction to a central axis of the reflecting mirror; and multiple primary radiators provided at respective positions of the multiple focal points, wherein the reflecting mirror comprises:

a first parabolic mirror having a first focal point;

a second parabolic mirror having a second focal point; and a metal member provided between the first parabolic mirror and the second parabolic mirror, wherein the respective positions of the first focal point and the second focal point are aligned with positions of the multiple primary radiators that are adjacent to each other in the perpendicular direction.

2. The antenna device according to claim 1, wherein an interfocal distance between the first focal point and the second focal point is the same as a width, in a short-side direction, of the metal member.

3. An antenna device comprising:

a reflecting mirror having multiple focal points which are located on a single straight line in a perpendicular direction to a central axis of the reflecting mirror; and multiple primary radiators provided at respective positions of the multiple focal points, wherein the multiple primary radiators comprises a first primary radiator and a second primary radiator that are adjacent to each other in the perpendicular direction, and the reflecting mirror comprises a parabolic mirror surface passing through midpoints between a hypothetical first parabolic mirror, a focal point of which is aligned with the position of the first primary radiator, and a hypothetical second parabolic mirror, a focal point of which is aligned with the position of the second primary radiator.

4. A method for designing an antenna device, wherein the antenna device includes a reflecting mirror having multiple focal points which are located on a single straight line in a perpendicular direction to a central axis of the reflecting mirror, and multiple primary radiators provided at respective positions of the multiple focal points, wherein the reflecting mirror includes:

a first parabolic mirror having a first focal point;

a second parabolic mirror having a second focal point; and a metal member provided between the first parabolic mirror and the second parabolic mirror, wherein the method comprises:

installing, at prescribed positions that are adjacent to each other in the perpendicular direction, a first primary radiator and a second primary radiator of the multiple primary radiators that can radiate electromagnetic waves towards the reflecting mirror; and configuring a mirror surface of the reflecting mirror so as to have the first focal point and the second focal point, the first focal point being aligned with an installation position of the first primary radiator, and the second focal point being aligned with an installation position of the second primary radiator.

* * * * *